US010766684B2

(12) United States Patent
Lv

(10) Patent No.: US 10,766,684 B2
(45) Date of Patent: Sep. 8, 2020

(54) LIQUID CRYSTAL PANEL PACKAGING BOX WITH TEMPERATURE REGULATING FUNCTION

(71) Applicant: HUIZHOU CHINA STAR OPTOELECTRONICS TECHNOLOGY CO., LTD., Huizhou Guangdong (CN)

(72) Inventor: Chengling Lv, Huizhou Guangdong (CN)

(73) Assignee: HUIZHOU CHINA STAR OPTOELECTRONICS TECHNOLOGY CO., LTD., Huizhou (CN)

( * ) Notice: Subject to any disclaimer, the term of this patent is extended or adjusted under 35 U.S.C. 154(b) by 330 days.

(21) Appl. No.: 15/752,758

(22) PCT Filed: Jan. 18, 2018

(86) PCT No.: PCT/CN2018/073274

§ 371 (c)(1),
(2) Date: Feb. 14, 2018

(87) PCT Pub. No.: WO2019/127737

PCT Pub. Date: Jul. 4, 2019

(65) Prior Publication Data

US 2020/0130916 A1 Apr. 30, 2020

(30) Foreign Application Priority Data

Dec. 25, 2017 (CN) ..... 2017 1 1419170

(51) Int. Cl.

| | |
|---|---|
| ***B65D 81/18*** | (2006.01) |
| ***B65D 85/30*** | (2006.01) |
| ***F25D 31/00*** | (2006.01) |

(52) U.S. Cl.
CPC ..... *B65D 81/18* (2013.01); *B65D 85/30* (2013.01); *F25D 31/005* (2013.01)

(58) Field of Classification Search
CPC ..... B65D 81/18; B65D 85/30; B65D 85/48; B65D 81/05; F25D 31/005; F25D 3/06; F25D 2331/804
See application file for complete search history.

(56) References Cited

U.S. PATENT DOCUMENTS

| | | | | |
|---|---|---|---|---|
| 2010/0001008 | A1* | 1/2010 | McCarthy | B65D 13/02 220/592.2 |
| 2012/0305435 | A1* | 12/2012 | Matta | F25D 3/06 206/521 |
| 2016/0362240 | A1* | 12/2016 | Ferracamo, Jr. | A61J 1/165 |

FOREIGN PATENT DOCUMENTS

| | | |
|---|---|---|
| CN | 201419873 | 3/2010 |
| CN | 102874461 A | 1/2013 |

(Continued)

*Primary Examiner* — Elizabeth J Martin
(74) *Attorney, Agent, or Firm* — Hemisphere Law, PLLC; Zhigang Ma

(57) ABSTRACT

A temperature regulating liquid crystal panel packaging box is provided, including a box body and a temperature regulator, the box body includes an accommodating part, the temperature regulator is arranged in the accommodating part to release or absorb heat as an outside temperature changes to keep an internal temperature of the box body balanced. In the liquid crystal panel packaging box, by disposing a temperature regulator on the periphery of the box body, when the outside temperature changes, the temperature regulator may spontaneously absorb heat or release heat to regulate the temperature inside the box body, thereby reducing the temperature difference between the inside and outside the box and preventing the water vapor in the air from condensing inside the box.

3 Claims, 3 Drawing Sheets

(56) References Cited

FOREIGN PATENT DOCUMENTS

| | | | |
|---|---|---|---|
| CN | 202728910 | | 2/2013 |
| CN | 203173159 | | 9/2013 |
| CN | 104097827 | A | 10/2014 |
| CN | 204016604 | U | 12/2014 |
| CN | 104495079 | | 4/2015 |
| CN | 105752494 | | 7/2016 |
| CN | 106966066 | A | 7/2017 |
| CN | 206528876 | U | 9/2017 |
| WO | 2016/189090 | A1 | 12/2016 |

* cited by examiner

LIQUID CRYSTAL PANEL PACKAGING BOX WITH TEMPERATURE REGULATING FUNCTION

RELATED APPLICATIONS

The present application is a National Phase of International Application Number PCT/CN2018/073274, filed Jan. 18, 2018, and claims the priority of China Application No. 201711419170.3, filed Dec. 25, 2017.

FIELD OF THE DISCLOSURE

The disclosure relates to the field of liquid crystal panel packaging and more particularly to a liquid crystal panel packaging box with a temperature regulating function.

BACKGROUND

At present, the most commonly used materials for the packaging of open cell panels are foam cushioning materials, such as Expandable Polyethylene (EPE) and expanded polypropylene (EPP). The packaging method is basically a sealed way, that is, each box is closely stacked, wrapped around the stack with a wrap film, and covered with a polyethylene (PE) waterproof membrane on the top of the stack. However, it is not uncommon to find that mist or water droplets sometimes form inside the wrap film or even the box after a product is shipped to a destination for unpacking.

There are two reasons for this phenomenon: first, the water vapor in high humidity environment through the outer protective film and the top cover film into the package; second, the temperature difference between different environments lead to the condensation of water vapor into water droplets and stored in the box body. After a variety of ways to try and found that the temperature difference between inside and outside the box is the main reason for the box body into the water. In response to this phenomenon, the common practice is to place a desiccant inside the box to absorb moisture, but the effect is not ideal. And the location of the desiccant is fixed; the desiccant cannot completely absorb the moisture in all parts of the box.

SUMMARY

The technical problem to be solved by the disclosure is to overcome the shortcomings of the prior art and to provide a liquid crystal panel packaging box, which may dynamically regulate the internal temperature of the box.

To achieve the object, the disclosure adopts the following technical solutions:

A liquid crystal panel packaging box with a temperature regulating function includes a box body and a temperature regulator, the box body includes an accommodating part, the temperature regulator is arranged in the accommodating part, and the temperature regulator is configured to release or absorb heat as an outside temperature changes to keep an internal temperature of the box body balanced.

Optionally, the temperature regulator includes a shell with a hollow interior and a phase change material filled in the shell.

Optionally, a number of the accommodating part and the temperature regulator are plural, and the plurality of accommodating parts are spaced on a frame of the box body.

Optionally, an inner wall and/or an outer wall of the frame includes the accommodating parts having a rectangle shape, and the accommodating parts extend along a length of the frame, a shape of the shell matches that of each of the accommodating parts, and the shell is accommodated in each of the accommodating parts.

Optionally, the main body has a cuboid shape, a number of the protrusions are two, two of the protrusions are respectively disposed on two opposite surfaces of the main body, and the two protrusions respectively extend toward a direction of a length of the frame.

Optionally, the phase change material is paraffin or sodium sulfate decahydrate.

In the liquid crystal panel packaging box with temperature regulating function disclosed by the disclosure, by disposing a temperature regulator on the periphery of the box body, when the outside temperature changes, the temperature regulator may spontaneously absorb heat or release heat so as to regulate the temperature inside the box body, thereby reducing the temperature difference between the inside and outside the box and preventing the water vapor in the air from condensing inside the box.

DETAILED DESCRIPTION OF PREFERRED EMBODIMENTS

In order to make the objectives, technical solutions and advantages of the disclosure more comprehensible, the disclosure is further described in detail below with reference to the accompanying drawings and embodiments. It is to be understood that the specific embodiments described herein are merely illustrative of the disclosure and are not intended to be limiting of the disclosure.

Embodiment 1

Figure 1:
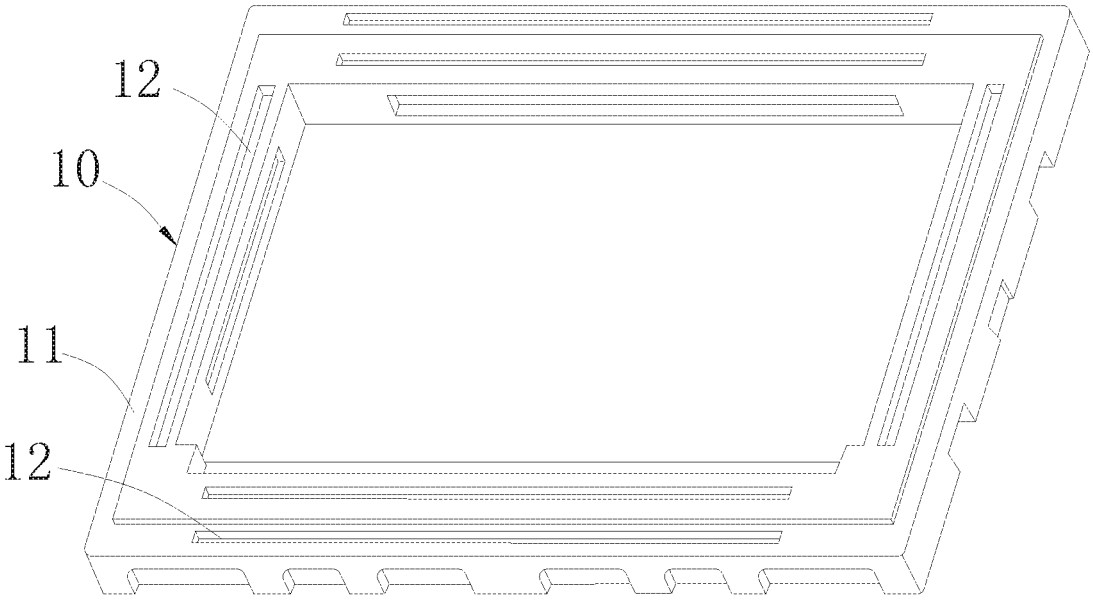
FIG. 1 is a schematic diagram of a box body according to a first embodiment of the disclosure.
Figure 2:
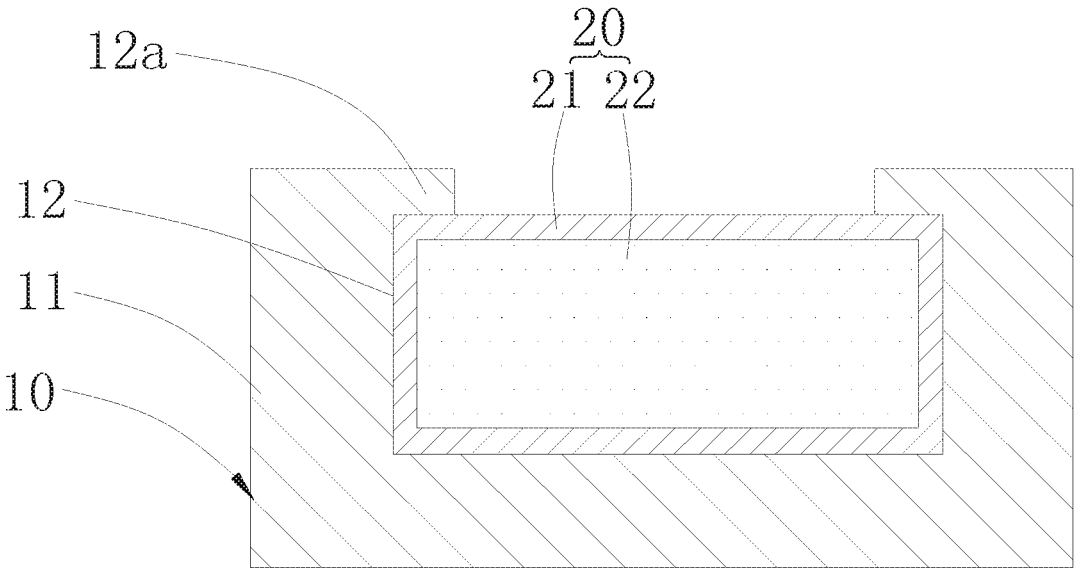
FIG. 2 is a cross-sectional view of a liquid crystal panel packaging box according to a first embodiment of the disclosure.

As shown in FIG. 1 and FIG. 2, the liquid crystal panel packaging box with temperature regulating function of the present embodiment mainly includes a box body 10 and a temperature regulator 20. The box body 10 includes an accommodating part 12, and the temperature regulator 20 is disposed on an accommodating part 12. When the outside temperature rises, the temperature regulator 20 absorbs the heat, so that the temperature inside the box body 10 does not increase or increases a little; when the outside temperature is lowered, the temperature regulator 20 releases the energy so that the interior temperature of the box body 10 does not decrease or decrease a little so that when the outside temperature changes, the temperature inside the box body 10 will always be stable, so that the temperature difference between the inside and outside of the box body 10 is relatively small so as to avoid condensation of water vapor in the air into beads attached to the liquid crystal panel inside the box.

As a preferred embodiment, the temperature regulator 20 uses a phase change material temperature regulator. Specifically, the temperature regulator 20 includes a shell 21 and a phase change material 22. The interior of the shell 21 is hollow and defines an enclosed cavity. The phase change material 22 is filled in the shell 21. The phase change material 22 can change between a liquid state and a solid state according to a change in temperature, thereby dynamically regulating the temperature in the box body 10 to prevent the formation of waterdrops in the box body 10. The material of the shell 21 is made of a metal material with good thermal conductivity, such as copper and silver, or uses an aluminum-plastic composite material and the like, and the shell thickness of the shell 21 should be as thin as possible. Considering the environment in which the liquid crystal panel packaging box is implemented, the phase change material 22 is preferably a normally low temperature phase change material, such as sodium sulfate decahydrate or paraffin, which is sensitive to temperature changes at room temperature and has a better temperature regulatory effect.

Specifically, the box body 10 has a frame shape. Optionally, the box body 10 is a rectangular frame. The number of the accommodating part 12 and the temperature regulator 20 are both plural, the plurality of accommodating parts 12 are spaced on the frame 11 of the box body 10, so that the plurality of temperature regulators 20 are spaced at the periphery of the box body 10 to facilitate regulation of the internal temperature of the box by the temperature regulator 20.

Further, the frame 11 includes an accommodating part 12 with an elongated shape. As preferred examples of embodiment, an inner wall 13 of the frame 11 includes an accommodating part 12 with an elongated shape, the accommodating part 12 extends along the length of the frame 11, a shape of the shell 21 matches the shape of the accommodating part 12, and the shell 21 is accommodated in the accommodating part 12. As a preferred embodiment, the accommodating part 12 is a cuboid cavity. Of course, in other embodiments, the accommodating part 12 can also be a cylinder shape, an elliptical cylinder shape, a triangular prism shape, or the like.

Further, as shown in FIG. 2, a blocking part 12*a* is disposed on a side wall near the opening of the accommodating part 12. The blocking part 12*a* abuts the surface of the shell 21 away from the accommodating part 12; the limit of the shell 21 may be achieved, thereby preventing the shell from falling off the accommodating part 12. Further, the surface of the shell 21 away from the accommodating part 12 includes a recessed part, and the blocking part 12*a* is snapped into the shell 21, so that the shell 21 may be more stably fixed.

Of course, in other embodiments, both an outer wall and a surface located between an inner wall and the outer wall of the frame 11 includes the accommodating parts 12 with an elongated shape. Each of the accommodating parts 12 extends along the length of the frame 11. In this way, more temperature regulators 20 can be installed on the box body 10 to further improve the temperature regulation capability inside the box.

Embodiment 2

Figure 3:
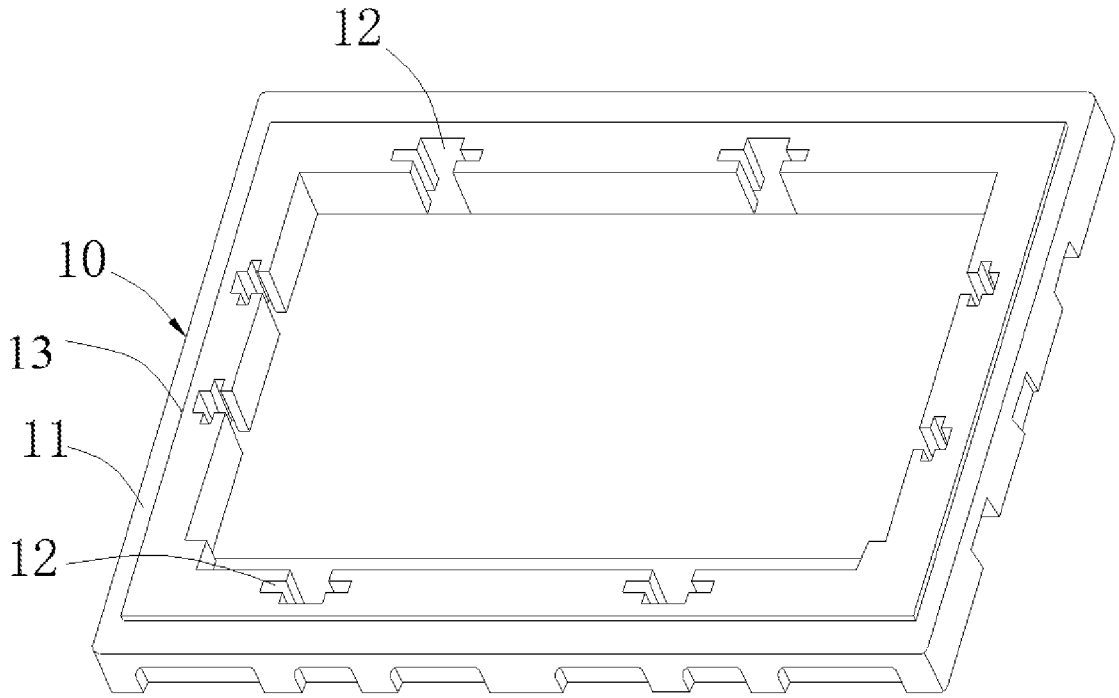
FIG. 3 is a schematic diagram of a box body according to a second embodiment of the disclosure.
Figure 4:
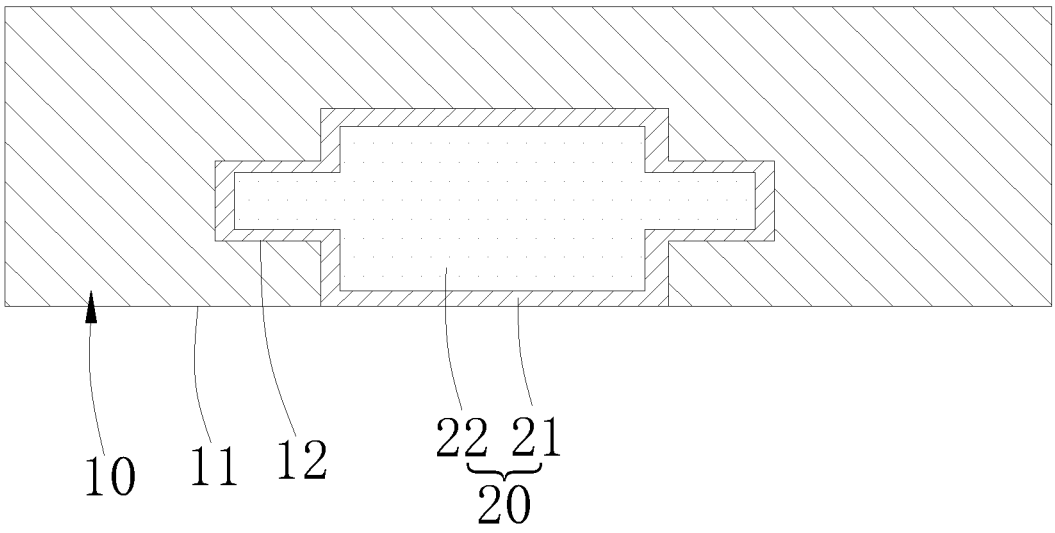
FIG. 4 is a cross-sectional view of a liquid crystal panel packaging box according to a second embodiment of the disclosure.
Figure 5:
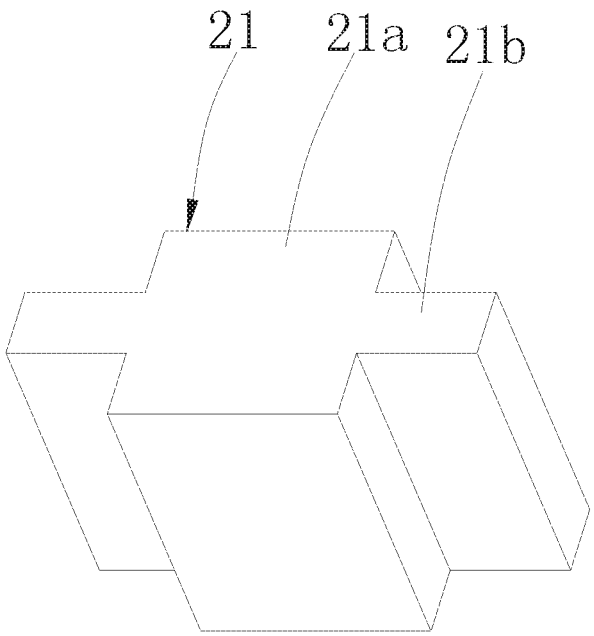
FIG. 5 is a schematic diagram of a shell of a temperature regulator according to a second embodiment of the disclosure.

As shown in FIG. 5, the liquid crystal panel packaging box with the temperature regulating function in the second embodiment is different from the first embodiment in that the shell 21 includes a main body 21*a* and a protrusion 21*b* disposed on a surface of the main body 21*a*. The main body 21*a* and the protrusion 21*b* both have a hollow interior. As shown in FIG. 3 and FIG. 4, a plurality of accommodating parts 12 are disposed on the inner wall of each of the frame 11 at intervals, the shape of the accommodating part 12 matches the shape of the shell 21, the shell 21 is inserted into the accommodating part 12, and the main body 21*a* and the protrusion 21*b* abuts the inner wall of the accommodating part 12.

As a preferred embodiment, the main body 21*a* has a cuboid shape, a number of the protrusions 21*b* is two, two of the protrusions 21*b* are respectively disposed on two opposite surfaces of the main body 21*a*, and the two protrusions 21*b* respectively extends toward a direction of a length of the frame 11. The accommodating part 12 can limit the position of the shell 10 to prevent the temperature regulator 20 from falling off.

In the liquid crystal panel packaging box with temperature regulating function disclosed by the disclosure, by disposing a temperature regulator on the periphery of the box body, when the outside temperature changes, the temperature regulator may spontaneously absorb heat or release heat so as to regulate the temperature inside the box body, thereby reducing the temperature difference between the inside and outside the box and preventing the water vapor in the air from condensing inside the box.

While specific embodiments of the invention have been described in detail, while some embodiments have been shown and described, it will be understood by those skilled in the art that various changes and modifications may be made without departing from the spirit and scope of the invention as defined by the appended claims and their equivalents, These embodiments may be modified and improved, and these modifications and improvements should also fall within the protection scope of the disclosure.

What is claimed is:

1. A liquid crystal panel packaging box with a temperature regulating function, comprising:

a box body; and a plurality of temperature regulators;

wherein the box body comprises a frame, and a plurality of accommodating parts are spaced on an inner wall of the frame, the temperature regulators are arranged in the accommodating parts so as to release or absorb heat as an outside temperature changes to keep an internal temperature of the box body balanced;

wherein each of the temperature regulators comprises a shell with a hollow interior and a phase change material filled in the shell, the shell comprises a main body and a protrusion disposed on a surface of the main body, the main body and the protrusion both have a hollow interior, a shape of the accommodating parts is matched with that of the shell, the shell is inserted into the accommodating parts, and the main body and the protrusion both abut an inner wall of the accommodating parts.

2. The liquid crystal panel packaging box with temperature regulating function according to claim 1, wherein the main body has a cuboid shape, a number of the protrusions is two, two of the protrusions are respectively disposed on two opposite surfaces of the main body, and the two protrusions respectively extends toward a direction of a length of the frame.

3. The liquid crystal panel packaging box with temperature regulating function according to claim 1, wherein the phase change material is paraffin or sodium sulfate decahydrate.

* * * * *